US008691487B2

(12) United States Patent
Aoki et al.

(10) Patent No.: US 8,691,487 B2
(45) **Date of Patent: *Apr. 8, 2014**

(54) ELECTROPHOTOGRAPHIC TONER

(71) Applicant: Toshiba Tec Kabushiki Kaisha, Tokyo (JP)

(72) Inventors: Takayasu Aoki, Shizuoka-ken (JP); Yasuhito Noda, Shizuoka-ken (JP); Koji Imamiya, Kanagawa-ken (JP); Tsuyoshi Itou, Shizuoka-ken (JP); Noboru Furuyama, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/920,410

(22) Filed: Jun. 18, 2013

(65) Prior Publication Data

US 2013/0279944 A1 Oct. 24, 2013

Related U.S. Application Data

(63) Continuation of application No. 12/950,158, filed on Nov. 19, 2010, now Pat. No. 8,486,598.

(60) Provisional application No. 61/263,499, filed on Nov. 23, 2009, provisional application No. 61/323,613, filed on Apr. 13, 2010.

(51) Int. Cl.
*G03G 9/08* (2006.01)

(52) U.S. Cl.
USPC ..... 430/109.4; 430/108.1; 399/252

(58) Field of Classification Search
USPC ..... 430/109.4, 108.1; 399/252
See application file for complete search history.

(56) References Cited

U.S. PATENT DOCUMENTS

| | | | | |
|---|---|---|---|---|
| 5,432,534 | A | 7/1995 | Maruyama et al. | |
| 6,203,603 | B1 | 3/2001 | Takayama et al. | |
| 6,329,317 | B1 | 12/2001 | Takayama et al. | |
| 7,820,349 | B2 | 10/2010 | Takagi et al. | |
| 8,486,598 | B2 * | 7/2013 | Aoki et al. | 430/109.4 |
| 2007/0207402 | A1 | 9/2007 | Takagi et al. | |
| 2008/0227015 | A1 | 9/2008 | Nagatomo et al. | |
| 2010/0209839 | A1 | 8/2010 | Kabai et al. | |
| 2011/0123921 | A1 | 5/2011 | Aoki et al. | |

(Continued)

FOREIGN PATENT DOCUMENTS

| | | |
|---|---|---|
| EP | 0980028 | 2/2000 |
| EP | 2219081 | 8/2010 |

(Continued)

OTHER PUBLICATIONS

Japanese Office Action for Japanese Application No. 2010-261338 mailed on Oct. 30, 2012.

(Continued)

*Primary Examiner* — Mark A Chapman
(74) *Attorney, Agent, or Firm* — Amin, Turocy & Watson, LLP

(57) ABSTRACT

An electrophotographic toner contains an electron donating color former compound, an electron accepting color developing agent, and a binder resin, wherein a toluene insoluble content in the electrophotographic toner is 10% by mass or more and 40% by mass or less, and the toner is decolorized by heating.

18 Claims, 3 Drawing Sheets

(56) References Cited

U.S. PATENT DOCUMENTS

| | | | |
|---|---|---|---|
| 2011/0212397 | A1 | 9/2011 | Aoki et al. |
| 2011/0262857 | A1 | 10/2011 | Aoki et al. |
| 2013/0279944 | A1 | 10/2013 | Aoki et al. |

FOREIGN PATENT DOCUMENTS

| | | |
|---|---|---|
| JP | 05-072800 | 3/1993 |
| JP | 2000-019770 | 1/2000 |
| JP | 2000-056497 | 2/2000 |
| JP | 2001-188381 | 7/2001 |
| JP | 2003-114587 | 4/2003 |
| JP | 2007-233101 | 9/2007 |
| JP | 2008-233806 | 10/2008 |
| JP | 2009-229785 | 10/2009 |
| JP | 2011-113093 | 6/2011 |

OTHER PUBLICATIONS

Korean Office Action for Korean Application No. 10-2010-116169 mailed on May 31, 2012.

European Extended Search Report for European Application No. 10191748.2 mailed Jun. 28, 2012.

Japanese Office Action for Japanese Patent Application No. 2013-036294 mailed on Nov. 26, 2013.

* cited by examiner

FIG. 2

| | EXAMPLE 1 | EXAMPLE 2 | EXAMPLE 3 | EXAMPLE 4 | EXAMPLE 5 | COMPARATIVE EXAMPLE 1 | COMPARATIVE EXAMPLE 2 | COMPARATIVE EXAMPLE 3 |
|---|---|---|---|---|---|---|---|---|
| WEIGHT AVERAGE MOLECULAR WEIGHT | 6300 | 7500 | 14000 | 24000 | 10000 | 8000 | 5800 | 27000 |
| ACID VALUE OF TONER (mgKOH/g) | 15 | 12 | 15 | 19 | 5 | 23 | 10 | 29 |
| GLASS TRANSITION POINT OF TONER (°C) | 50 | 60 | 62 | 60 | 37 | 60 | 45 | 70 |
| SOFTENING POINT OF TONER (°C) | 95 | 90 | 100 | 115 | 82 | 101 | 77 | 130 |
| TOLUENE INSOLUBLE CONTENT (% BY MASS) | 20 | 12 | 24 | 37 | 15 | LESS THAN 5 | LESS THAN 5 | 45 |
| FIXING TEMPERATURE (°C) | 85 | 90 | 95 | 95 | - | 90 | 80 | 120 |
| DECOLORIZATION TEMPERATURE (°C) | 120 | 120 | 120 | 120 | - | 120 | 120 | - |
| GLOSSINESS IN DECOLORIZED REGION | LESS THAN 10 | LESS THAN 10 | LESS THAN 10 | LESS THAN 10 | - | 20 | 35 | - |

FIG. 3

| | | EXAMPLE 7 | EXAMPLE 8 | EXAMPLE 9 | EXAMPLE 10 | EXAMPLE 11 | EXAMPLE 12 | EXAMPLE 13 | EXAMPLE 14 |
|---|---|---|---|---|---|---|---|---|---|
| GLASS TRANSITION POINT OF TONER (°C) | | 48 | 25 | 65 | 48 | 48 | 48 | 48 | 48 |
| NUMBER OF TYPES OF INORGANIC FINE PARTICLES | | 2 | 2 | 2 | 1 | 1 | 1 | 2 | 2 |
| AVERAGE PRIMARY PARTICLE DIAMETER OF INORGANIC FINE PARTICLES (nm) | 1ST TYPE | 40 | 40 | 40 | 15 | 230 | 100 | 40 | 22 |
| | 2ND TYPE | 100 | 100 | 100 | - | - | - | 100 | 100 |
| COVERAGE WITH FINE PARTICLES HAVING AN AVERAGE PRIMARY PARTICLE DIAMETER OF 50 nm OR MORE AND 200 nm OR LESS ALONE (%) | | 18 | 18 | 12 | 0 | 0 | 56 | 8 | 27 |
| COVERAGE WITH ALL OF FINE PARTICLES (%) | | 95 | 95 | 65 | 145 | 53 | 56 | 45 | 180 |
| STORAGE STABILITY | | A | C | A | B | B | B | C | B |
| GLOSSINESS IN DECOLORIZED REGION | | A | C | A | C | A | A | A | A |
| LOW-TEMPERATURE FIXABILITY | | A | A | C | A | A | A | A | B |
| PRINTING DURABILITY | | A | C | B | A | C | C | C | C |

ELECTROPHOTOGRAPHIC TONER

CROSS-REFERENCE TO RELATED APPLICATIONS

This application is a Continuation of Application Ser. No. 12/950,158 filed Nov. 19, 2010, which is based upon and claims the benefit of priority from: U.S. provisional application 61/263,499, filed on Nov. 23, 2009; and U.S. provisional application 61/323,613, filed on Apr. 13, 2009; the entire contents all of which are incorporated herein by reference.

FIELD

Embodiments described herein relate to a technique for a decolorizable toner which is decolorized by heating.

BACKGROUND

Conventionally, in order to enable the reuse of paper used for printing or note-taking for the purpose of temporal transfer, display, or the like of information, a heat-sensitive recording medium (heat-sensitive paper) capable of erasing printing by heating, or a pigment or the like, which is decolorized by heating, is used.

Further, as a toner for an image forming apparatus such as a multifunction peripheral (MFP), a so-called decolorizable toner, which is decolorized by heating, is also used. A sheet having an image formed thereon using the decolorizable toner can be reused after the image is decolorized because the toner is decolorized by heating.

However, the conventional decolorizable toner has problems that the decolorization performance is not sufficient, and for example, a gloss in a region where an image formed on a sheet was decolorized is noticeable, and so on.

DESCRIPTION OF THE DRAWINGS

FIG. 2 is a table showing evaluation of toners of Examples and Comparative Examples according to a first embodiment.

FIG. 3 is a table showing evaluation of toners of Examples according to a second embodiment.

DETAILED DESCRIPTION

Figure 1:
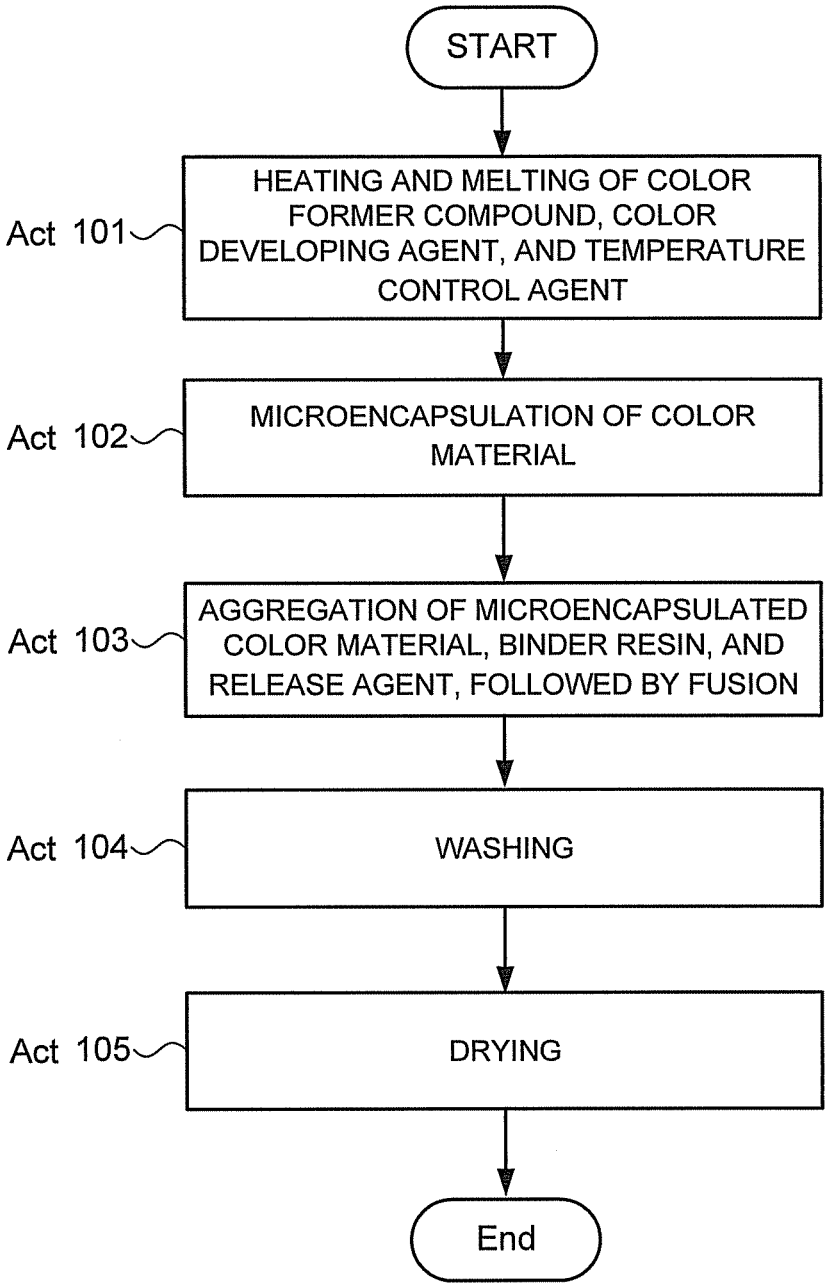
FIG. 1 is a flow chart showing a flow of a process for producing a toner.

In general, according to an embodiment, an electrophotographic toner contains an electron donating color former compound, an electron accepting color developing agent, and a polyester binder resin having a weight average molecular weight Mw of 6000 or more and 25000 or less, and the toner is decolorized by heating.

Hereinafter, embodiments will be described with reference to the drawings.

First Embodiment

An electrophotographic toner according to this embodiment is a so-called decolorizable toner which is decolorized by heating.

The toner according to this embodiment contains at least an electron donating color former compound, an electron accepting color developing agent, and a binder resin. The binder resin is a polyester resin and has a weight average molecular weight Mw measured by gel permeation chromatography (GPC) of 6000 or more and 25000 or less.

The electron donating color former compound is a dye precursor compound to be used for displaying characters, figures, etc. As the electron donating color former compound, a leuco dye can be mainly used. The leuco dye is an electron donating compound capable of developing a color by the action of a color developing agent, and examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The electron accepting color developing agent is an electron accepting compound which causes the color former compound to develop a color by interacting with the color former compound. Also the electron accepting color developing agent is an electron accepting compound which donates a proton to the electron donating color former compound such as a leuco dye.

Examples of the electron accepting color developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof.

The binder resin is melted by a fixing treatment and fixes a coloring material on a sheet.

As the binder resin, a polyester resin obtained by subjecting a dicarboxylic acid component and a diol component to an esterification reaction, followed by polycondensation is used. A styrene resin generally has a higher glass transition point than a polyester resin and therefore is disadvantageous from the viewpoint of low-temperature fixing.

Examples of the dicarboxylic acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component (diol component) include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; and alicyclic diols such as 1,4-cyclohexanediol and 1,4-cyclohexanedimethanol. Additional examples thereof include ethylene oxide adducts or propylene oxide adducts of bisphenol A (such as bisphenol A alkylene oxide adducts).

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

Further, as the binder resin, two or more types of polyester resins having different compositions may be mixed and used.

The polyester resin may be crystalline or noncrystalline. The glass transition point of the polyester resin is preferably 45° C. or higher and 70° C. or lower, more preferably 50° C. or higher and 65° C. or lower. If the glass transition point is lower than 45° C., the heat-resistant storage stability of the toner is deteriorated, and also a gloss derived from the resin after decolorization is noticeable, and therefore, it is not preferred. Meanwhile, if the glass transition point is higher than 70° C., the low-temperature fixability is deteriorated, and also the decolorizing property when heating is poor, and therefore, it is not preferred.

The weight average molecular weight Mw of the binder resin is preferably 6000 or more and 25000 or less. If the weight average molecular weight Mw is less than 6000, a gloss derived from the resin in a decolorized region is noticeable, and therefore, it is not preferred. Meanwhile, if the weight average molecular weight Mw exceeds 25000, the fixing temperature of the toner is generally higher than the decolorization temperature of an image, and the toner cannot be used as a decolorizable toner, and therefore, it is not preferred.

Incidentally, the weight average molecular weight Mw can be measured by GPC as described above.

In addition, it is preferred that the electron donating color former compound and the electron accepting color developing agent of the toner are microencapsulated as a color material. By the microencapsulation of these components, the components are rarely affected by the external environment, and the color development and decolorization can be freely controlled.

It is preferred that the resulting microcapsules serving as the color material further contain a temperature control agent. The temperature control agent controls the decolorization temperature. The temperature control agent is a substance having a large temperature difference between the melting point and the solidification point. When the temperature control agent is heated to a temperature not lower than the melting point of the temperature control agent, the color material can be decolorized. Further, when the solidification point of the temperature control agent is normal temperature or lower, the color material maintained in a decolorized state even at normal temperature can be formed.

Examples of the temperature control agent include an alcohol, an ester, a ketone, an ether, and an acid amide.

Particularly preferred is an ester. Specific examples thereof include an ester of a carboxylic acid containing a substituted aromatic ring, an ester of a carboxylic acid containing an unsubstituted aromatic ring with an aliphatic alcohol, an ester of a carboxylic acid containing a cyclohexyl group in the molecule, an ester of a fatty acid with an unsubstituted aromatic alcohol or a phenol, an ester of a fatty acid with a branched aliphatic alcohol, an ester of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used by mixing two or more of them.

Subsequently, the physical properties of the toner will be described.

The glass transition point (Tg) of the toner is preferably 35° C. or higher and 65° C. or lower. If the glass transition point (Tg) of the toner is lower than 35° C., the heat-resistant storage stability of the toner is deteriorated, and also a gloss derived from the toner when the toner is decolorized by heating is noticeable, and therefore, it is not preferred. Meanwhile, if the glass transition point (Tg) of the toner is higher than 65° C., the low-temperature fixability is deteriorated, and also the property of decolorization by heating is deteriorated.

The softening point (Tm) of the toner is preferably 80° C. or higher and 120° C. or lower. If the softening point (Tm) of the toner is lower than 80° C., the storage stability of the toner is deteriorated. Meanwhile, if the softening point (Tm) of the toner is higher than 120° C., the fixing temperature is increased, and therefore, it is not preferred from the viewpoint of energy saving.

The toluene insoluble content in the toner is preferably 10% by mass or more and 40% by mass or less. The toluene insoluble content is a numerical value indicating the degree of crosslinking of a resin contained in the toner. If the toluene insoluble content is more than 40% by mass, the fixing temperature of the toner is generally higher than the decolorization temperature at which the decolorizable toner is decolorized. Meanwhile, if the toluene insoluble content is less than 10% by mass, even when the decolorizable toner is heated to decolorize the toner, a gloss derived from the resin in the decolorized region is noticeable, and therefore, it is not preferred.

The acid value (AV value) of the toner is preferably 25 mgKOH/g or less. The acid value of the toner refers to the amount (mg) of potassium hydroxide required for neutralizing free fatty acids contained in 1 g of fat and oil. If the acid value of the toner exceeds 25 mgKOH/g, when the encapsulation of the color material is not sufficient, the toner functions as a color developing agent, and the color is redeveloped, and therefore, it is not preferred.

Further, the toner may contain a release agent, a charge control agent, or the like.

The release agent improves the releasing property from a fixing member when the toner is fixed on a sheet by heating or applying pressure. Examples of the release agent include aliphatic hydrocarbon waxes such as low molecular weight polyethylenes having a molecular weight of about 1000, low molecular weight polypropylenes having a molecular weight of about 1000, polyolefin copolymers, polyolefin wax, paraffin wax, and Fischer-Tropsch wax, and modified products thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; functional synthetic waxes; and silicone waxes.

In this embodiment, it is particularly preferred that the release agent has an ester bond composed of an alcohol component and a carboxylic acid component. Examples of the alcohol component include higher alcohols, and examples of the carboxylic acid component include saturated fatty acids having a linear alkyl group; unsaturated fatty acids such as monoenoic acid and polyenoic acid; and hydroxyl fatty acids. Further, as the carboxylic acid component, an unsaturated polyvalent carboxylic acid such as maleic acid, fumaric acid, citraconic acid, or itaconic acid may be used. Further, an anhydride thereof may also be used.

The softening point of the release agent is from 50° C. to 120° C., more preferably from 60° C. to 110° C. for enabling the fixing at a low temperature from the viewpoint of low energy or prevention of curling of a sheet.

The charge control agent controls a frictional charge quantity.

As the charge control agent, a metal-containing azo compound is used, and the metal element is preferably a complex or a complex salt of iron, cobalt, or chromium, or a mixture thereof. Further, as the charge control agent, a metal-containing salicylic acid derivative compound may also be used, and the metal element is preferably a complex or a complex salt of zirconium, zinc, chromium, or boron, or a mixture thereof.

Incidentally, in the toner, an external additive in addition to toner particles may be mixed.

The external additive adjusts the fluidity or chargeability of the toner. The external additive can be mixed in an amount of from 0.01 to 20% by mass of the total amount of the toner particles. The external additive comprises inorganic fine particles, and silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be added as the external additive for improving the cleaning property.

Subsequently, the process for producing the toner according to this embodiment will be described with reference to FIG. 1. FIG. 1 is a flow chart showing a flow of a process for producing a toner. First, a color material composed of a color former compound, a color developing agent, and a temperature control agent is heated and melted (Act 101). Then, the color material is microencapsulated by a coacervation method (Act 102). The microencapsulated color material, a binder resin dispersion liquid in which a binder resin is dispersed, and a release agent dispersion liquid in which a release agent is dispersed are aggregated using aluminum sulfate ($Al_2(SO_4)_3$), followed by fusing (Act 103). Then, the fused material is washed (Act 104) and dried (Act 105), whereby a toner is obtained.

Incidentally, the method for the microencapsulation of the color material is not limited to the coacervation method, and a method by polymer deposition, a method using an isocyanate polyol wall material, a method using a urea-formaldehyde or urea-formaldehyde-resorcinol wall forming material, a method using a wall forming material such as a melamine-formaldehyde resin or hydroxypropyl cellulose, an in-situ method by monomer polymerization, an electrolytic dispersion cooling method, a spray-drying method, or the like may be used.

The toner according to this embodiment as described above develops a color by binding the color former compound such as a leuco dye to the color developing agent such as a phenolic compound. When the color former compound and the color developing agent are dissociated from each other, the color is erased. Further, the toner according to this embodiment decolorizes at a temperature not lower than the fixing temperature of the toner.

Subsequently, the toner according to this embodiment will be further described with reference to Examples.

First, processes for producing toners of respective Examples and Comparative Examples will be described.

Example 1

First, a finely pulverized binder resin and wax dispersion liquid was prepared by mixing 95 parts by weight of a polyester resin having a weight average molecular weight Mw of 6300 obtained by polycondensation of terephthalic acid and bisphenol A as a binder resin to be contained in a toner, 5 parts by weight of rice wax as a release agent, 1.0 parts by weight of Neogen R (manufactured by Dai-ichi Kogyo Seiyaku Co., Ltd.) as an anionic emulsifying agent, and 2.1 parts by weight of dimethylaminoethanol as a neutralizing agent using a high-pressure homogenizer.

Subsequently, a color material was prepared by mixing 10 parts by weight of crystal violet lactone (CVL) which is a leuco dye as a color former compound, 10 parts by weight of benzyl 4-hydroxybenzoate as a color developing agent, and 80 parts by weight of 4-benzyloxyphenylethyl laurate as a temperature control agent, and heating and melting the resulting mixture. Then, the color material was microencapsulated by a coacervation method.

Then, 10 parts by weight of the microencapsulated color material and 90 parts by weight of the finely pulverized binder resin and wax dispersion liquid were aggregated using aluminum sulfate ($Al_2(SO_4)_3$), followed by fusing. Then, the fused material was washed and dried, whereby toner particles were obtained. Subsequently, 3.5 wt% of hydrophobic silica ($SiO_2$) and 0.5 wt% of titanium oxide ($TiO_2$) were externally added and mixed with 100 parts by weight of the toner particles, whereby a toner of Example 1 was obtained.

Example 2

A finely pulverized binder resin and wax dispersion liquid was prepared in the same manner as in Example 1 except for changing the physical properties of the binder resin (weight average molecular weight Mw: 7500) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 2 was obtained.

Example 3

A finely pulverized binder resin and wax dispersion liquid was prepared in the same manner as in Example 1 except for changing the physical properties of the binder resin (weight average molecular weight Mw: 14000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 3 was obtained.

Example 4

A finely pulverized binder resin and wax dispersion liquid was prepared in the same manner as in Example 1 except for changing the physical properties of the binder resin (weight average molecular weight Mw: 24000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 4 was obtained.

Example 5

A finely pulverized binder resin and wax dispersion liquid was prepared in the same manner as in Example 1 except for changing the physical properties of the binder resin (weight average molecular weight Mw: 10000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 5 was obtained.

Example 6

A finely pulverized binder resin and wax dispersion liquid was prepared in the same manner as in Example 1 except for changing the physical properties of the binder resin (weight average molecular weight Mw: 8000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 6 was obtained.

Comparative Example 1

A finely pulverized binder resin and wax dispersion liquid was prepared in the same manner as in Example 1 except for changing the physical properties of the binder resin (weight average molecular weight Mw: 5800) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Comparative Example 1 was obtained.

Comparative Example 2

A finely pulverized binder resin and wax dispersion liquid was prepared in the same manner as in Example 1 except for changing the physical properties of the binder resin (weight average molecular weight Mw: 27000) and the release agent. Also, a microencapsulated color material was prepared in the same manner as in Example 1. Then, the color material and the finely pulverized binder resin and wax dispersion liquid were mixed in the same manner as in Example 1, whereby a toner of Comparative Example 2 was obtained.

For the toners of Examples 1 to 6 and Comparative Examples 1 and 2 described above, the weight average molecular weight Mw of the binder resin, the acid value, the glass transition point Tg (° C.), the softening point Tm (° C.), the toluene insoluble content (% by mass), the fixing temperature of the toner, the decolorization temperature at which the toner is decolorized, and the glossiness in the decolorized region are shown in FIG. 2.

The weight average molecular weight Mw was measured by the GPC method for each of the binder resins used in the respective Examples and Comparative Examples. In the measurement, an instrument manufactured by WATERS, Inc. was used. As the detector, a differential refractive index detector (RI) manufactured by WATERS, Inc. was used. As the eluent (mobile phase), tetrahydrofuran (THF) was used.

The acid value was determined by the amount (mg) of potassium hydroxide required for neutralizing all of the acid components in the wax according to Test Method for Neutralization of Petroleum Products and Lubricants stipulated in Japanese Industrial Standards JIS K 2501-2003.

The glass transition point (Tg) was measured using a differential scanning calorimeter (DSC) manufactured by TA Instruments, Inc.

The softening point (Tm) was measured using a flow tester (CFT-500D) manufactured by Shimadzu Corporation.

The toluene insoluble content was determined by measuring the insoluble content after each of the toners of Examples and Comparative Examples was immersed in toluene for 2 hours, and was expressed in % by mass.

The glossiness in a region where the toner was decolorized is a value obtained by forming an image on a sheet using each of the toners of Examples and Comparative Examples, heating the formed image to decolorize the image, and then, measuring the glossiness in the decolorized region. The measurement was performed using a glossmeter (VG-2000) manufactured by Nippon Denshoku Industries Co., Ltd. according to Test Method for Specular Glossiness (JIS Z 8741) at an incident and reflection angle of 60°.

When discussing the physical properties of the toners of Examples and Comparative Examples described above, the values for the toners of Examples fall within favorable ranges with respect to all evaluation items, and also the glossiness after decolorization was low.

Incidentally, the toner of Example 6 had an acid value of more than 25 mgKOH/g and a toluene insoluble content of less than 5% by mass. The glossiness in the decolorized region was not high, but the color of the toner remained in the decolorized region.

On the other hand, as for Comparative Examples, the toner of Comparative Example 1 had a weight average molecular weight of less than 6000, a softening point of lower than 80°

C., and a toluene insoluble content of less than 5% by mass, and therefore, a gloss derived from the resin in the decolorized region was noticeable.

Further, the toner of Comparative Example 2 had a weight average molecular weight of more than 25000 and a fixing temperature as high as 120° C., and therefore, when the toner was heated to the fixing temperature, the toner was decolorized. Accordingly, the toner is not preferred because it cannot be used as a decolorizable toner.

As described above, according to this embodiment, a toner having excellent low-temperature fixability and giving a gloss which is not noticeable after decolorization can be produced.

Second Embodiment

A second embodiment will be described. A toner according to this embodiment is different from the toner according to the first embodiment in that the toner according to this embodiment further contains inorganic fine particles having a specific average primary particle diameter.

This embodiment is based on the finding that a gloss can be further suppressed by subjecting the toner according to the first embodiment to a specific external addition treatment.

Specifically, the toner according to the second embodiment contains a color material composed of a color former compound such as a leuco dye and a color developing agent, a binder resin, and further inorganic fine particles of at least one kind of substance having an average primary particle diameter of 50 nm or more and 200 nm or less. Further, the coverage of the toner with the inorganic fine particles having an average primary particle diameter of 50 nm or more and 200 nm or less is 30% or less per fine particles of one kind of substance, and the coverage of the toner with all of the inorganic fine particles contained in the toner, regardless of the average primary particle diameter, is 50% or more and 150% or less.

For example, when two kinds of substances: silica and titania are used as fine particles, the coverage with silica fine particles having an average primary particle diameter of from 50 to 200 nm and the coverage with titania fine particles having an average primary particle diameter of from 50 to 200 nm are 30% or less, respectively. Further, as for the coverage with all of the inorganic fine particles, the coverage with all of the silica and titania fine particles is 50% or more and 150% or less, which is a value obtained without considering the particle diameter or the kind of substance.

Here, the "average primary particle diameter" refers to a "number average particle diameter". The number average particle diameter is determined by measuring the particle diameters (the average of the major and minor axis lengths) of 100 particles using a scanning electron microscope at an appropriate magnification in the range from 5000× to 50000×, and the average of the measured particle diameters is used as the average primary particle diameter.

Further, the "coverage" as used herein is defined by the following calculation formula.

Coverage=(volume average particle diameter of toner particles/average primary particle diameter of inorganic fine particles)×(absolute specific gravity of toner particles/absolute specific gravity of inorganic fine particles)×(weight of inorganic fine particles/weight of toner)×100

In the formula, the "volume average particle diameter" refers to 50% volume average particle diameter determined using a coulter counter Multisizer 3 manufactured by Beckman Coulter, Inc.

By adding such inorganic fine particles having a specific particle diameter such that the coverage of the toner with the inorganic fine particles is a specific value, light scattering is caused due to the inorganic fine particles of the toner fixed on a sheet, and therefore, a gloss can be suppressed. Accordingly, a gloss in a region where the toner was decolorized, can be made more unnoticeable.

Here the "light scattering" is called Mie scattering among light scattering forms. When the size of inorganic fine particles is approximately equal to the wavelength of light (when the size is larger than one-tenth of the wavelength), the visible light is scattered by the fine particles and a gloss is suppressed.

Examples of the inorganic fine particles include silica, titania, alumina, strontium titanate, and tin oxide. As the inorganic fine particles, these can be used alone or by mixing two or more of them.

It is necessary that the average primary particle diameter of the inorganic fine particles for scattering light is 50 nm or more and 200 nm or less as described above. If the average primary particle diameter is less than 50 nm, a gloss cannot be effectively suppressed by the added inorganic fine particles. Meanwhile, if the average primary particle diameter is more than 200 nm, the fine particles are released from the toner or toner scattering occurs, and therefore, the printing durability is deteriorated. Here, the "toner scattering" refers to a phenomenon in which the toner scatters in a region of a photoconductor where the toner should not be adhered or around the photoconductor during development and so on, resulting in making the inside and the outside of the machine dirty.

The amount of the inorganic fine particles to be mixed with the toner is preferably such that the coverage with the fine particles having an average primary particle diameter of 50 nm or more and 200 nm or less is 30% or less per fine particles of one kind of substance as described above. If the coverage exceeds 30%, the fine particles are released from the toner or toner scattering occurs, and therefore, the printing durability is deteriorated. Incidentally, it is more preferred that the coverage with the fine particles having an average primary particle diameter of 50 nm or more and 200 nm or less is 10% or more per fine particles of one kind of substance from the viewpoint of reduction in glossiness. Further, it is preferred that the coverage with all of the fine particles contained in the toner is 50% or more and 150% or less as described above. If the coverage is less than 50%, the fluidity or resistance to environmental change required as an external additive for a toner cannot be ensured, and therefore, the storage stability is deteriorated, and as a result, the printing durability is deteriorated. Meanwhile, if the coverage exceeds 150%, the percentage of the released fine particles in the toner is increased, and therefore, the charge amount of the toner is decreased, and as a result, the printing durability is deteriorated.

Incidentally, the "storage stability" refers to a property in which the toner particles are prevented from aggregating while storing the toner and the toner can be stably stored in a state where the fluidity is maintained.

Further, the "printing durability" refers to image stability for repeated printing and also includes fogging and toner scattering.

Further, the toner preferably has a glass transition point Tg of 30° C. or higher and 65° C. or lower. If the glass transition point Tg is lower than 30° C., when the toner fixed on a sheet is decolorized, a gloss in the decolorized region is noticeable, and therefore, it is not preferred. However, the toner according to this embodiment contains inorganic fine particles that suppress a gloss by scattering light, and therefore, the lower limit of the glass transition point can be set to 30° C. which is lower than the preferred lower limit (35° C.) set in the first embodiment. The matter that the low-temperature fixability is deteriorated when the glass transition point Tg exceeds 65° C. is the same as in the first embodiment.

Subsequently, a process for producing the toner according to this embodiment will be described. A toner is produced by the production process described in the first embodiment, and then, the above-mentioned inorganic fine particles are added to the toner in a given amount. As described above, the addition amount thereof is such that the coverage of the toner with the inorganic fine particles having an average primary particle diameter of 50 nm or more and 200 nm or less is 30% or less per fine particles of one kind of substance, and the coverage of the toner with all of the inorganic fine particles contained in the toner, regardless of the average primary particle diameter, is from 50 to 150%.

As described above, with the use of the toner according to this embodiment, due to the fine particles covering the toner particles composed of the color material, the binder resin, and the like, light is scattered and a gloss is further suppressed. Therefore, when an image is formed with the toner and the image is decolorized, a gloss in the decolorized region is more unnoticeable.

Subsequently, the toner according to this embodiment will be further described with reference to Examples.

First, processes for producing toners of respective Examples will be described.

Example 7

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 3 parts by weight of inorganic fine particles of hydrophobic silica having an average primary particle diameter of 40 nm and 2 parts by weight of inorganic fine particles of hydrophobic silica having an average primary particle diameter of 100 nm were mixed by stirring, whereby a toner of Example 7 was obtained.

Example 8

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 3 parts by weight of inorganic fine particles of hydrophobic silica having an average primary particle diameter of 40 nm and 2 parts by weight of inorganic fine particles of hydrophobic silica having an average primary particle diameter of 100 nm were mixed by stirring, whereby a toner of Example 8 was obtained.

Example 9

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 2 parts by weight of inorganic fine particles of hydrophobic silica having an average primary particle diameter of 40 nm and 1.2 parts by weight of inorganic fine particles of hydrophobic silica having an average primary particle diameter of 100 nm were mixed by stirring, whereby a toner of Example 9 was obtained.

Example 10

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 2 parts by weight of inorganic fine particles of hydrophobic silica having an average primary particle diameter of 15 nm were mixed by stirring, whereby a toner of Example 10 was obtained.

Example 11

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 12 parts by weight of inorganic fine particles of hydrophobic silica having an average primary particle diameter of 230 nm were mixed by stirring, whereby a toner of Example 11 was obtained.

Example 12

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 5.5 parts by weight of inorganic fine particles of hydrophobic silica having an average primary particle diameter of 100 nm were mixed by stirring, whereby a toner of Example 12 was obtained.

Example 13

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 1.2 parts by weight of inorganic fine particles of hydrophobic silica having an average primary particle diameter of 40 nm and 1.2 parts by weight of inorganic fine particles of hydrophobic silica having an average primary particle diameter of 100 nm were mixed by stirring, whereby a toner of Example 13 was obtained.

Example 14

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 3.5 parts by weight of inorganic fine particles of hydrophobic silica having an average primary particle diameter of 22 nm and 2 parts by weight of inorganic fine particles of hydrophobic silica having an average primary particle diameter of 100 nm were mixed by stirring, whereby a toner of Example 14 was obtained.

A table showing the glass transition point Tg (° C.), the number of types of fine particles, the average primary particle diameter of the fine particles (nm), the coverage with the fine particles having an average primary particle diameter of from 50 to 200 nm alone, the coverage with all of the fine particles, the storage stability, the glossiness after decolorization, the low-temperature fixability, and the printing durability for the toners of Examples 7 to 14 described above is shown in FIG. 3.

The storage stability was evaluated as follows. 20 g of the obtained toner of Example was weighed in a container, and the container was immersed in a constant temperature water tank at 50° C. for 8 hours. Then, by using a powder tester (manufactured by Hosokawa Micron Corporation), the container containing the toner was tapped three times, and thereafter, the toner was poured onto a 42-mesh sieve. Then, the sieve was vibrated by a powder tester (manufactured by Hosokawa Micron Corporation) for 10 seconds, and the amount of the toner remaining on the sieve was measured and evaluated in three grades: A: extremely good; B: good; and C: problematic.

The glossiness of the toner after decolorization was determined as follows. An image was formed on a sheet with the obtained toner using a multifunction peripheral (MFP) manufactured by Toshiba Tec Corporation, and the sheet having the image formed thereon was conveyed to a fixing device in which the fixing temperature was set to 150° C. at a paper feed rate of 200 mm/sec, whereby the image was decolorized. Then, the glossiness in the decolorized region was measured using a glossmeter manufactured by Nippon Denshoku Industries Co., Ltd.

In the toners of the respective Examples, the weight average molecular weight of the resin was 6300, which is in the preferred range of the weight average molecular weight described in the first embodiment, and therefore, the toners were generally favorable for glossiness, however, there was a difference in the level of the glossiness. Therefore, based on the glossiness of the toner of Example 1 described in the first embodiment, the glossiness was evaluated in three grades: A: extremely good; B: good; and C: moderate (equal to that of Example 1).

The printing durability was evaluated as follows. The obtained toner of Example was mixed with a carrier at a given ratio, the resulting mixture was placed in a MFP (e-STUDIO 4520) manufactured by Toshiba Tec Corporation modified for evaluation, and then, a paper feed test in which 10000 sheets of paper were fed through the MFP was performed. Then, the printing durability was evaluated comprehensively based on the results of evaluation for the charge amount of the toner after the paper feed test, fogging when the image was output, and toner scattering in the inside of the machine. The printing durability was evaluated also in three grades (A: extremely good; B: good; and C: problematic) in the same manner as the storage stability.

The toner of Example 7 was obtained by mixing two types of fine particles and satisfied the above-mentioned conditions for all of the items of the glass transition point Tg, the average primary particle diameter of the fine particles, and the coverage. Further, the evaluation of the toner for the storage stability, the glossiness in the decolorized region, the low-temperature fixability, and the printing durability was also favorable.

The toner of Example 8 had a glass transition point Tg of 25° C., which is lower than 30° C., and the low-temperature fixability was good, but the storage stability was not sufficient due to the too low Tg. Therefore, the effect on reduction in glossiness was not so obtained. Further, in the test for the printing durability, since the Tg was low, the fine particles were embedded in the toner, and therefore, the charge amount was decreased, fogging and toner scattering occurred, and thus, the evaluation for the printing durability was not favorable.

Meanwhile, the toner of Example 9 had a glass transition point Tg of 65° C., which is high, and therefore, although the evaluation for the storage stability and the glossiness was favorable, but the low-temperature fixability was not sufficient.

The toner of Example 10 was obtained by adding one type of fine particles, and the average primary particle diameter of the fine particles was 15 nm, which is smaller than 50 nm. Therefore, the coverage with the fine particles having an average primary particle diameter of from 50 to 200 nm was 0%. As a result, the effect on reduction in glossiness was not so obtained.

In the toner of Example 11, the average primary particle diameter of the fine particles was 230 nm, which exceeds 200 nm. Since the average primary particle diameter of the fine particles was too large, the adhesion force of the external additive to the toner was low, and the external additive was detached from the toner, and therefore, the charge amount was decreased, fogging and toner scattering occurred, and thus, the evaluation for the printing durability was low.

In the toner of Example 12, the coverage with the fine particles having an average primary particle diameter of from 50 to 200 nm was 56%, which exceeds 30%. Therefore, the external additive was liable to be released from the toner, and the toner from which the external additive was detached scattered and so on, and thus, the printing durability was deteriorated.

In the toner of Example 13, the coverage with all of the fine particles was 45%, which is lower than 50%. Therefore, the fluidity or resistance to environmental change required as an external additive for a toner could not be ensured, and thus, the evaluation for the storage stability and the printing durability was not favorable.

In the toner of Example 14, the coverage with all of the fine particles was 180%, which exceeds 150%. Therefore, the toner from which the external additive was detached scattered and so on, and thus, the printing durability was not favorable.

As described above, the toner of Example 7 which satisfies all of the conditions described in this embodiment has excellent storage stability, low-temperature fixability, and printing durability, and also a gloss after decolorization is further unnoticeable, and therefore is the best among the toner of Examples.

As described in detail in the above, according to the technique described in this specification, a toner which gives a less gloss after decolorization can be provided.

While certain embodiments have been described, these embodiments have been presented by way of example only, and are not intended to limit the scope of invention. Indeed, the novel compound described herein may be embodied in a variety of other forms; furthermore, various omissions, substitutions and changes in the form of the compound described herein may be made without departing from the spirit of the inventions. The accompanying claims and their equivalents are intended to cover such forms or modifications as would fall within the scope and spirit of the inventions.

What is claimed is:

1. An electrophotographic toner, which is decolorized by heating, comprising an electron donating color former compound, an electron accepting color developing agent, and a binder resin, wherein a toluene insoluble content in the electrophotographic toner is 10% by mass or more and 40% by mass or less.

2. The toner according to claim 1, wherein the toner has a glass transition point of 35° C. or higher and 65° C. or lower.

3. The toner according to claim 1, wherein the toner has a softening point of 80° C. or higher and 120° C. or lower.

4. The toner according to claim 1, wherein the toner has an acid value of 25 mgKOH/g or less.

5. The toner according to claim 1, further comprising a temperature control agent.

6. The toner according to claim 5, wherein at least the electron donating color former compound, the electron accepting color developing agent, and the temperature control agent are microencapsulated.

7. The toner according to claim 1, wherein the toner is decolorized at a temperature higher than the fixing temperature of the toner.

8. The toner according to claim 1, further comprising at least one type of fine particles having an average primary particle diameter of 50 nm or more and 200 nm or less, wherein the coverage of toner particles of the toner with the fine particles having an average primary particle diameter of 50 nm or more and 200 nm or less is 30% or less per fine particles of one kind of substance, and the coverage of the toner particles with all of the fine particles is 50% or more and 150% or less.

9. The toner according to claim 8, wherein the fine particles comprise any of silica, titania, alumina, strontium titanate, and tin oxide.

10. The toner according to claim 1, wherein the electron donating color former compound is a leuco dye.

11. A toner cartridge containing the electrophotographic toner according to claim 1.

12. An image forming apparatus comprising the electrophotographic toner according to claim 1.

13. An electrophotographic toner, which is decolorizable with heat, comprising an electron donating color former compound, an electron accepting color developing agent, and a binder resin, wherein a toluene insoluble content in the electrophotographic toner is 10% by mass or more and 40% by mass or less.

14. The toner according to claim 13, further comprising a temperature control agent.

15. The toner according to claim 14, wherein at least the electron donating color former compound, the electron accepting color developing agent, and the temperature control agent are microencapsulated.

16. The toner according to claim 14, wherein the toner is decolorized with heat which make the temperature control agent heated to a temperature not lower than the melting point of the temperature control agent.

17. A toner cartridge containing the electrophotographic toner according to claim 13.

18. An image forming apparatus comprising the electrophotographic toner according to claim 13.

* * * * *